US009074751B2

(12) United States Patent
Son et al.

(10) Patent No.: US 9,074,751 B2
(45) Date of Patent: Jul. 7, 2015

(54) LIGHTING APPARATUS

(75) Inventors: Won-Kuk Son, Ansan-si (KR); Yevgeni Aliyev, Ansan-si (KR); Osmonalieva Gulmira, Ansan-si (KR)

(73) Assignee: Seoul Semiconductor Co., Ltd., Ansan-si (KR)

( * ) Notice: Subject to any disclaimer, the term of this patent is extended or adjusted under 35 U.S.C. 154(b) by 861 days.

(21) Appl. No.: 12/487,154

(22) Filed: Jun. 18, 2009

(65) Prior Publication Data

US 2009/0316383 A1 Dec. 24, 2009

(30) Foreign Application Priority Data

Jun. 20, 2008 (KR) ..... 10-2008-0058526
Jun. 30, 2008 (KR) ..... 10-2008-0062668

(51) Int. Cl.

| | |
|---|---|
| ***F21V 23/02*** | (2006.01) |
| ***F21V 9/16*** | (2006.01) |
| ***F21V 9/10*** | (2006.01) |
| ***F21V 14/00*** | (2006.01) |
| *F21Y 101/02* | (2006.01) |
| *F21V 7/00* | (2006.01) |
| *F21Y 103/00* | (2006.01) |

(52) U.S. Cl.

CPC ... *F21V 9/16* (2013.01); *F21V 9/10* (2013.01); *F21V 14/006* (2013.01); *F21Y 2101/02* (2013.01); *F21V 7/0008* (2013.01); *F21V 7/005* (2013.01); *F21Y 2103/003* (2013.01)

(58) Field of Classification Search

CPC ..... F21V 14/006; F21V 7/0008; F21V 7/005; F21V 9/10; F21V 9/16

USPC ..... 362/84, 260, 800, 231, 296.01

See application file for complete search history.

(56) References Cited

U.S. PATENT DOCUMENTS

| | | | | |
|---|---|---|---|---|
| 4,007,365 | A * | 2/1977 | Stempfle et al. | 362/283 |
| 6,252,254 | B1 * | 6/2001 | Soules et al. | 257/89 |
| 7,156,539 | B2 * | 1/2007 | Cronk | 362/297 |
| 7,638,780 | B2 * | 12/2009 | Kilburn et al. | 250/492.1 |
| 7,837,348 | B2 * | 11/2010 | Narendran et al. | 362/231 |
| 7,942,556 | B2 * | 5/2011 | Harbers et al. | 362/294 |
| 2007/0058357 | A1 * | 3/2007 | Yamaguchi et al. | 362/84 |
| 2008/0089085 | A1 * | 4/2008 | Popelek | 362/514 |
| 2008/0158856 | A1 * | 7/2008 | Shen | 362/84 |
| 2009/0103293 | A1 * | 4/2009 | Harbers et al. | 362/231 |

FOREIGN PATENT DOCUMENTS

| | | |
|---|---|---|
| KR | 199826951 | 7/1998 |
| KR | 1020060010368 | 2/2006 |
| KR | 100713226 | 5/2007 |

* cited by examiner

*Primary Examiner* — Anh Mai
*Assistant Examiner* — Jessica M Apenteng
(74) *Attorney, Agent, or Firm* — H.C. Park & Associates, PLC

(57) ABSTRACT

A lighting apparatus includes a light reflector, a light emitting diode (LED) and a light-changing film. The light reflector has a concave surface. The LED is disposed under the concave surface of the light reflector to provide the concave surface with light. The light-changing film converts a first light generated by the LED into a second light. For example, the light-changing film may be a fluorescent film receiving the first light and emitting the second light with increased wavelength. The LED and the light-changing film are spaced apart from each other to minimize discoloration of the light-changing film.

23 Claims, 7 Drawing Sheets

LIGHTING APPARATUS

CROSS REFERENCE TO RELATED APPLICATION

This application claims priority from and the benefit of Korean Patent Application No. 2008-58526, filed on Jun. 20, 2008 and Korean Patent Application No. 2008-62668, filed on Jun. 30, 2008, which are both hereby incorporated by reference for all purposes as if fully set forth herein.

BACKGROUND OF THE INVENTION

1. Field of the Invention

Exemplary embodiments of the present invention relate to a lighting apparatus and, more particularly, to a lighting apparatus without color temperature change, which is capable of adjusting a width and a color of light.

2. Discussion of the Background

In general, a light-emitting diode (LED) has qualities such as high efficiency, long lifespan, low power consumption, environmentally-friendly, etc., as a light source. Therefore, the LED is widely used in various industrial fields.

A conventional LED lighting apparatus emits white light by mixing red light generated by a red LED, green light generated by a green LED, and blue light generated by a blue LED. Alternatively a conventional LED lighting apparatus emits white light by a white LED employing a blue LED chip and yellow fluorescent substance converting a portion of blue light generated by the blue LED into yellow light to mix the yellow light with a remaining blue light in order to generate white light. In the conventional LED lighting apparatus, the LED lighting apparatus employing a blue LED chip and yellow fluorescent substance occupies a major area.

In general, an LED emits heat, so that the fluorescent substance in the LED may be damaged by the heat. Therefore, when the LED is used for a long period of time, the fluorescent substance in the LED may become discolored, resulting in the desired white light to be changed into another colored light. Furthermore, when a lighting apparatus employing this type of LED is equipped in a confined space, the change in white color or discoloration may have serious effects.

SUMMARY OF THE INVENTION

Exemplary embodiments of the present invention provide a lighting apparatus without color temperature change.

Exemplary embodiments of the present invention also provide a lighting apparatus capable of adjusting color required by a user.

Additional features of the invention will be set forth in the description which follows, and in part will be apparent from the description, or may be learned by practice of the invention.

An exemplary embodiment of the present invention discloses a lighting apparatus, with a light reflector having a concave surface; a light emitting diode (LED) disposed under the concave surface of the light reflector to provide the concave surface with light; and a light-changing film to convert a first light generated by the LED into a second light.

An exemplary embodiment of the present invention also discloses a lighting apparatus with a light reflector having a concave surface; a light-generating part disposed under the concave surface of the light reflector to provide the light reflector with light; and an illumination width adjusting part to adjust a width of the light reflector by compressing side portions of the light reflector.

An exemplary embodiment of the present invention also discloses a lighting apparatus with a light reflector; a light emitting diode (LED) part disposed under the light reflector, the LED part comprising at least one LED; a fluorescent film having first to n-th fluorescent substance parts, each of the first to n-th fluorescent substance parts to convert light generated by the LED into light with at least one different color; and a driving part to select one of the first to n-th fluorescent substance parts.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE INVENTION

Figure 1:
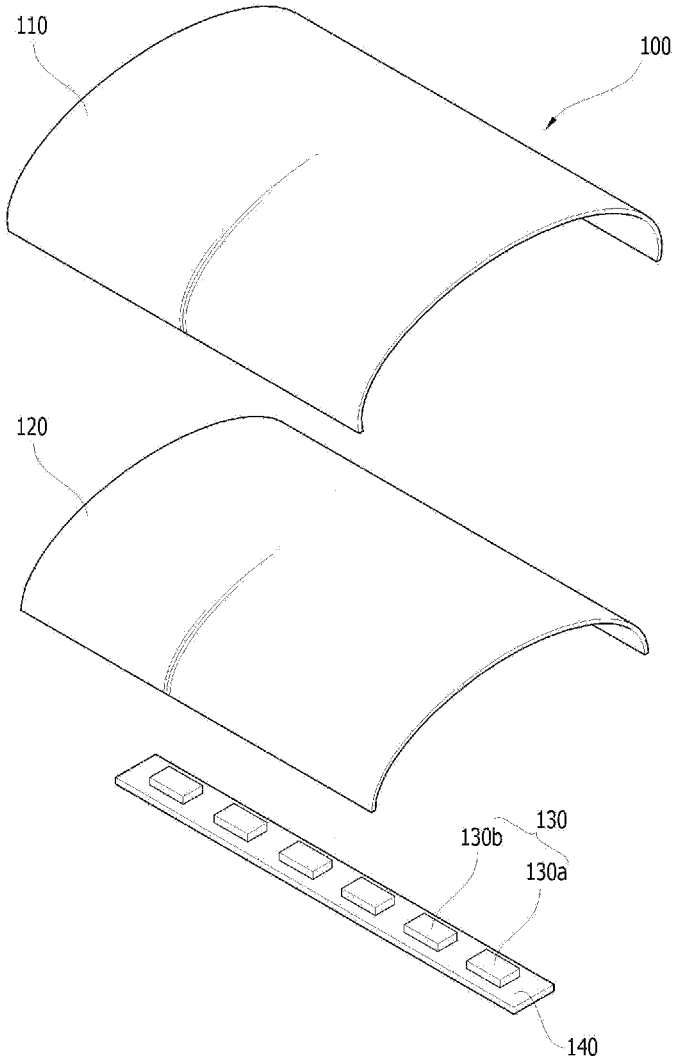
FIG. 1 is an exploded perspective view illustrating a lighting apparatus according to an exemplary embodiment of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

It will be understood that when an element or layer is referred to as being "on" or "connected to" another element or layer, it can be directly on or directly connected to the other element or layer, or intervening elements or layers may be present. In contrast, when an element is referred to as being "directly on" or "directly connected to" another element or layer, there are no intervening elements or layers present.

Figure 2:
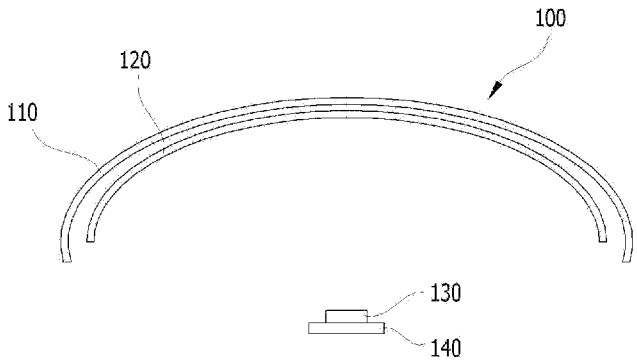
FIG. 2 is a cross-sectional view of the lighting apparatus in FIG. 1.

FIG. 1 is an exploded perspective view illustrating a lighting apparatus according to an exemplary embodiment of the present invention, and FIG. 2 is a cross-sectional view of the lighting apparatus in FIG. 1.

Referring to FIG. 1 and FIG. 2, a lighting apparatus 100 according to an exemplary embodiment of the present invention includes a light reflector 110, a fluorescent film 120 and at least one light emitting diode (LED) 130.

The light reflector 110 has, for example, an arch-shaped cross-section and is extended along a first direction. A concave surface of the light reflector 110 is a light-reflecting surface. The fluorescent film 120 may include, for example polymer. The fluorescent film 120 is disposed under the light reflector 110 to cover the concave surface of the light reflector 110.

The LEDs 130 are mounted on a printed circuit board (PCB) 140 in a line along the first direction. The LEDs 130 are spaced apart from each other. The LEDs 130 are disposed such that a first surface of the LEDs 130, through which light is emitted, faces the fluorescent film 120 and light reflector 110.

For example, a blue LED or an ultraviolet light (UV) LED may be employed as the LED 130. In this case, the fluorescent film 120 may include, for example, an optically transparent polymer, and fluorescent substance distributed in the optically transparent polymer to generate white light. Examples of the fluorescent substance include YAG fluorescent substance, barium-silicate based or strontium-gallium sulfide based green fluorescent substance or aluminum-terbium based yellow fluorescent substance.

Therefore, blue light or UV light generated by the LED 130 is changed by the fluorescent material of the fluorescent film 120. The light passing through the fluorescent film 120 is reflected by the light reflector 110 and repasses through the fluorescent film 120 to generate, for example white light.

Alternatively, the LEDs 130 may include blue LEDs 130*a* and red LEDs 130*b* alternately disposed with each other. In this case, color rendering property may be enhanced.

According to the lighting apparatus 100 described above, the LED 130 and the fluorescent film 120 converting the light generated by the LED 130 are spaced apart from each other, so that heat generated by the LED 130 is not transmitted to the fluorescent film 120. This prevents the fluorescent film 120 from being discolored and helps in maintaining a consistent color of the light.

The LED 130 has a first surface through which light is emitted and a second surface opposite to the first surface. In general, more heat is irradiated through the second surface of the LED 130 than the first surface. According to the lighting apparatus 100, the first surface of the LED 130 faces the fluorescent film 120, so that the second surface of the LED 130 faces an opposite direction of the fluorescent film 120. Therefore, radiant heat generated by the LED 130 is prevented from being transmitted to the fluorescent film 120.

As a result, discoloration of the fluorescent film 120 is prevented to maintain white light of the lighting apparatus 100, even when used extended periods of time.

Although not shown in FIG. 1 and FIG. 2, the fluorescent film 120 may be disposed under the LED 130. Furthermore, the fluorescent film 120 may be disposed such that the fluorescent film 120 makes contact with the PCB 140 on which the LED 130 is mounted. In this case, a portion of the fluorescent film 120, which makes contact with the LED 130, may be discolored by the heat. However, the fluorescent film 120 has a relative low thermal conductivity, so that only the portion in which no light passes through is discolored. As a result, the object of the present invention may be achieved.

Figure 3:
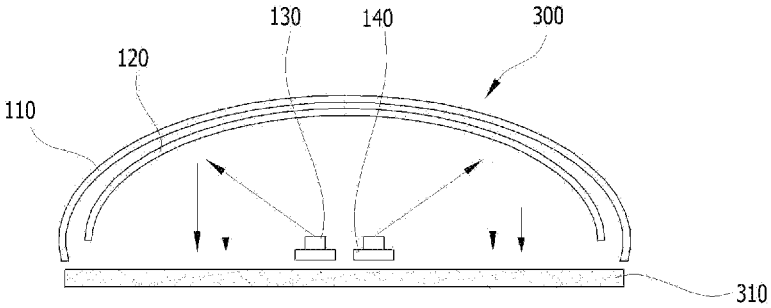
FIG. 3 is a cross-sectional view illustrating a lighting apparatus according to another exemplary embodiment of the present invention.

FIG. 3 is a cross-sectional view illustrating a lighting apparatus according to another exemplary embodiment of the present invention.

The lighting apparatus 300 in FIG. 3 is substantially the same as the lighting apparatus 100 in FIG. 1 and FIG. 2, except for an arrangement of the LEDs 130. Thus, same reference numbers will be used for the same elements and any further explanation will be omitted.

Referring to FIG. 3, the lighting apparatus 300 according to the present exemplary embodiment includes a light reflector 110, a fluorescent film 120 and an LED 130. The lighting apparatus 300 may further include a light-diffusing plate 310 to improve brightness uniformity by diffusing light generated by the LED 130.

Two lines of the LEDs 130 are disposed on two PCBs 140, respectively, along a first direction that is in the same longitudinal direction as the light reflector 110. Not shown in FIG. 3, the LEDs 130 may be arranged in two lines on one PCB 140 and the LEDs 130 may be disposed in more than two lines along the first direction. For example, the PCB 140 may be disposed directly on the light-diffusing plate 310.

The LEDs 130 may include blue LEDs or UV LEDs and red LEDs alternately disposed with each other. Furthermore, a first line of blue LEDs and a second line of blue LEDs may be disposed alternately to form a zigzag shape to improve brightness uniformity.

The LEDs 130 are disposed such that the LEDs 130 are spaced apart from the fluorescent film 120 and the first surface of the LED 130 faces the fluorescent film 120 and light reflector 110. Therefore, the second surface of the LEDs 130 faces opposite direction of the fluorescent film 120, so that radiant heat generated by the LED 130 is prevented from being transmitted to the fluorescent film 120.

As a result, discoloration of the fluorescent film is prevented to maintain initial color, and luminance is enhanced by increasing the number of LEDs 130.

Not shown in FIG. 3, the fluorescent film 120 may be disposed under the PCB 140. In detail, the fluorescent film 120 may be disposed on an upper or lower surface of the light-diffusing plate 310. In this case, a portion of the fluorescent film 120, which is adjacent to the LED 130, may be discolored by heat. However, the fluorescent film 120 has a relative low thermal conductivity, so that only the portion in which no light passes through is discolored. As a result, the object of the present invention may be achieved.

Figure 4:
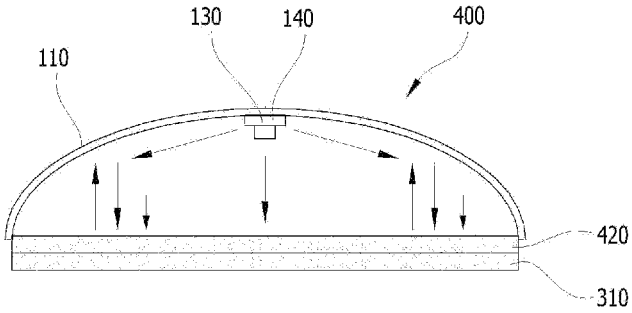
FIG. 4 is a cross-sectional view illustrating a lighting apparatus according to still another exemplary embodiment of the present invention.

FIG. 4 is a cross-sectional view illustrating a lighting apparatus according to still another exemplary embodiment of the present invention.

Referring to FIG. 4, a lighting apparatus 400 according to the present exemplary embodiment includes a light reflector 110, a fluorescent film 420 and an LED 130. The lighting apparatus 400 may further include a light-diffusing plate 310 to improve brightness uniformity by diffusing light generated by the LED 130.

The light reflector 110 has an arch-shaped cross-section and is extended along a first direction. A concave surface of the light reflector 110 corresponds to a light-reflecting surface.

The PCB 140, on which the LEDs 130 are mounted, is disposed on the concave surface of the light reflector 110. For example, the PCB 140 is disposed at a center portion of the light reflector 110 along the first direction. The first surface of the LED 130, through which light is emitted, faces the fluorescent film 420, and the second surface of the LED 130, which is opposite to the first surface, is attached to the light-reflecting surface of the light reflector 110.

The fluorescent film 420 may be disposed under the light reflector 110 to have a chord shape connecting end portions of the light reflector 110. The fluorescent film 420 may be disposed on an upper surface or a lower surface of the light-diffusing plate 110. The light-diffusing plate 310 and the fluorescent film 420 may be integrally formed with each other by dispersing fluorescent material into the light-diffusing plate 310.

For example, a blue LED or an ultraviolet light (UV) LED may be employed as the LED 130. In this case, the fluorescent film 420 may include, for example, an optically transparent polymer, and fluorescent substance distributed in the optically transparent polymer to generate white light. Examples of the fluorescent substance include YAG fluorescent substance, barium-silicate based or strontium-gallium sulfide based green fluorescent substance or aluminum-terbium based yellow fluorescent substance.

Therefore, blue light or UV light generated by the LED 130 is changed by the fluorescent material of the fluorescent film 420. The light generated by the LED 130 passes through the fluorescent film 420 to generate, for example white light.

Alternatively, the LEDs 130 may include blue LEDs 130*a* and red LEDs 130*b* alternately disposed with each other. In this case, color rendering property may be enhanced.

According to the lighting apparatus 400 described above, the LED 130 and the fluorescent film 420 converting the light generated by the LED 130 are spaced apart from each other, so that heat generated by the LED 130 is not transmitted to the fluorescent film 420.

Therefore, the fluorescent film 420 is prevented from being discolored to maintain color temperature of light.

The LED 130 has a first surface through which light is emitted and a second surface opposite to the first surface. In general, more heat is irradiated through the second surface of the LED 130 than the first surface. According to the lighting apparatus 400, the first surface of the LED 130 faces the fluorescent film 420, so that the second surface of the LED 130 faces an opposite direction of the fluorescent film 420. Therefore, radiant heat generated by the LED 130 is prevented from being transmitted to the fluorescent film 420.

As a result, discoloration of the fluorescent film 420 is prevented to maintain white light of the lighting apparatus 400.

Furthermore, the lighting apparatus 400 in FIG. 4 is a direct lighting type whereas the lighting apparatus 100 in FIG. 1 and FIG. 2 and the lighting apparatus 300 in FIG. 3 is an indirect lighting type, so that the lighting apparatus 400 may have improved luminance.

Figure 5:
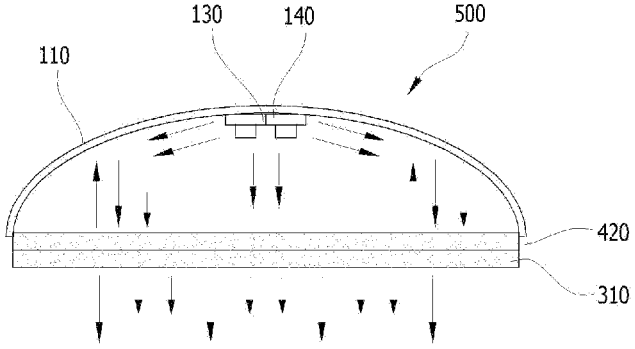
FIG. 5 is a cross-sectional view illustrating a lighting apparatus according to still another exemplary embodiment of the present invention.

FIG. 5 is a cross-sectional view illustrating a lighting apparatus according to still another exemplary embodiment of the present invention.

The lighting apparatus 500 in FIG. 5 is substantially the same as the lighting apparatus 400 in FIG. 4, except for an arrangement of the LEDs 130. Thus, same reference numbers will be used for the same elements and any further explanation will be omitted.

Referring to FIG. 5, the lighting apparatus 500 according to the present exemplary embodiment includes a light reflector 110, a fluorescent film 420 and an LED 130. The lighting apparatus 500 may further include a light-diffusing plate 310 to improve brightness uniformity by diffusing light generated by the LED 130.

Two lines of the LEDs 130 are disposed on two PCBs 140, respectively, along a first direction that is longitudinal direction of the light reflector 110. The two PCBs 140, on which the LEDs 130 are mounted, are disposed on a center portion of a concave surface of the light reflector 110 having an arch-shaped cross-section along the first direction. The first surface of the LED 130, through which light is emitted, faces a lower portion, and the second surface that is opposite to the first surface may be attached to a light-reflecting surface of light reflector 110. Not shown in FIG. 5, the LEDs 130 may be arranged in two lines on one PCB 140 and the LEDs 130 may be disposed in more than two lines along the first direction.

The LEDs 130 may include blue LEDs or UV LEDs and red LEDs alternately disposed with each other. Furthermore, a first line of blue LEDs and a second line of blue LEDs may be disposed alternately to form a zigzag shape to improve brightness uniformity.

The LEDs 130 are disposed such that the LEDs 130 are spaced apart from the fluorescent film 420 and the first surface of the LED 130 faces the fluorescent film 420. Therefore, the second surface of the LEDs 130 faces opposite direction of the fluorescent film 420, so that radiant heat generated by the LED 130 is prevented from being transmitted to the fluorescent film 420.

As a result, discoloration of the fluorescent film is prevented to maintain initial color, and luminance is enhanced by increasing the number of LEDs 130.

Figure 6:
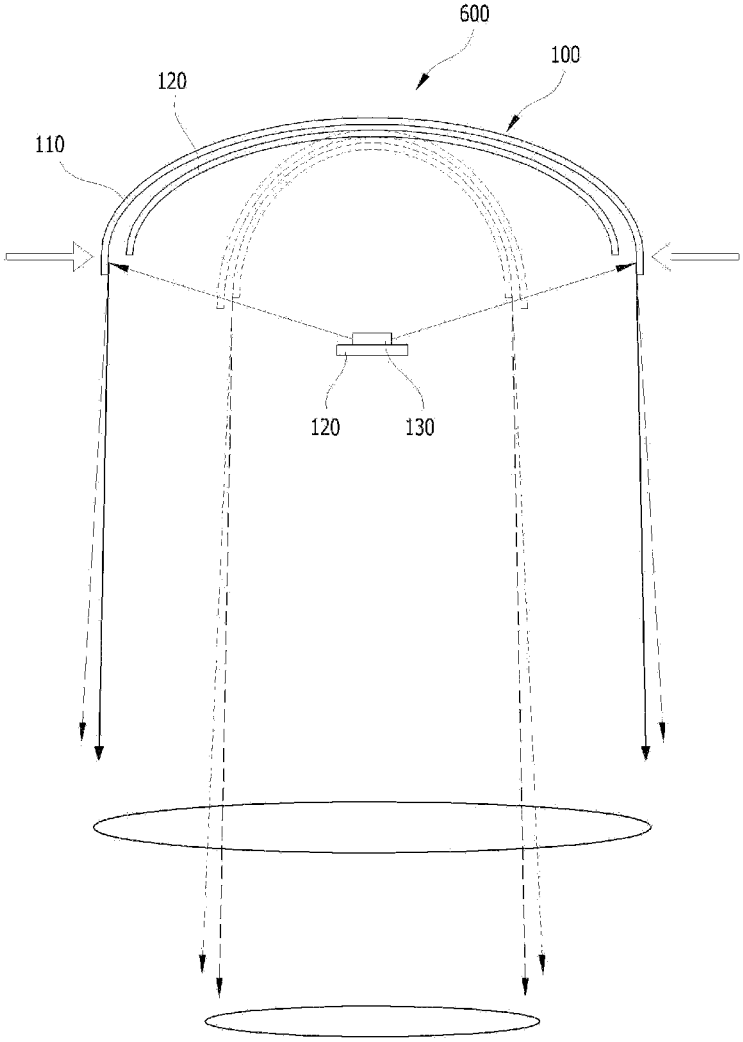
FIG. 6 is a conceptual view illustrating a lighting apparatus according to still another exemplary embodiment of the present invention.
Figure 7:
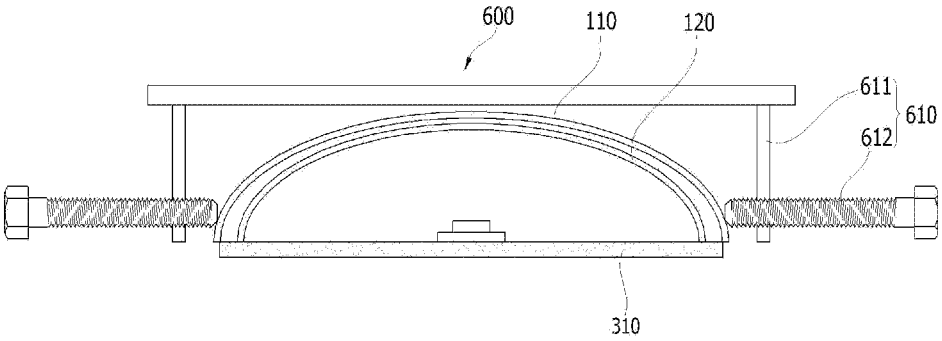
FIG. 7 is a cross-sectional view of the lighting apparatus in FIG. 6.

FIG. 6 is a conceptual view illustrating a lighting apparatus according to still another exemplary embodiment of the present invention, and FIG. 7 is a cross-sectional view illustrating the lighting apparatus embodying the conception of the lighting apparatus in FIG. 6.

The lighting apparatus 600 in FIG. 7 is substantially the same as the lighting apparatus 100 in FIG. 1 and FIG. 2, except for an illumination width adjusting part 610 and a light-diffusing plate 310. Thus, same reference numbers will be used for the same elements and any further explanation will be omitted.

Referring to FIG. 6 and FIG. 7, a lighting apparatus 600 according to the present exemplary embodiment includes a light reflector 110, a fluorescent film 120, an LED 130, a light-diffusing plate 310 and an illumination width adjusting part 610.

The light-diffusing plate 310 and fluorescent film 120 may include flexible materials.

The illumination width adjusting part 610 compresses side portions of the light reflector 110 to adjust width of the light reflector 110, so that width of illumination may be adjusted. In order for that, the illumination width adjusting part 610 may include, for example a supporting part 611 and a screw 612.

The supporting part 611 is disposed such that the supporting part 611 is adjacent to the side portions of the light reflector 110. The screw 612 passes through the supporting part 611. The screw 612 moves forward or backward to adjust the width of the light reflector 110 when the screw 612 rotates along a clock-wise direction or a counter clock-wise direction with respect to the supporting part 611.

In order to automatically adjust the width of the light reflector 110, the lighting apparatus 600 may further include a motor (not shown) connected to the screw 612 to rotate the screw 612 and a control part (not shown) controlling the motor.

In FIG. 6 and FIG. 7, the illumination width adjusting part 610 is equipped to the lighting apparatus 100 in FIG. 1 and FIG. 2. Although not shown in FIG. 3, FIG. 4 and FIG. 5, the illumination width adjusting part 610 may be equipped to the lighting apparatus 300, 400 and 500 in FIG. 3, FIG. 4 and FIG. 5.

As described above, according to the present embodiment, a width of lighting area may be adjusted when required. That is, the lighting apparatus 600 may illuminate a relatively small area with relatively high brightness or a relatively large area with relatively low brightness.

Hereinbefore, the lighting apparatuses employ the fluorescent film as an example, but other kind of a light-changing film changing characteristics of light may be employed. That is, the present invention is useful to all kinds of polymer film that may be damaged by heat generated by the LED.

Figure 8:
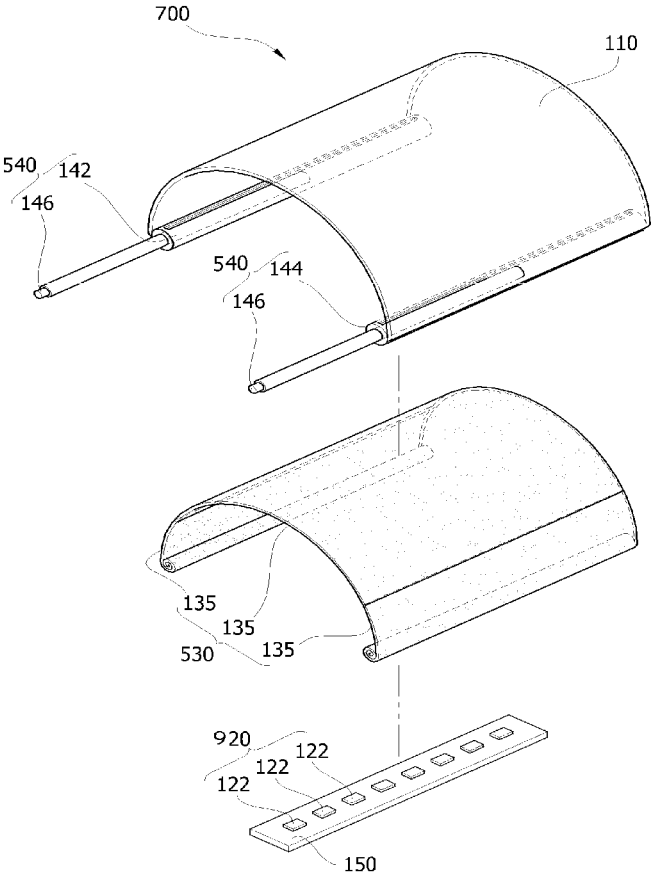
FIG. 8 is an exploded perspective view illustrating a lighting apparatus according to still another exemplary embodiment of the present invention.
Figure 9:
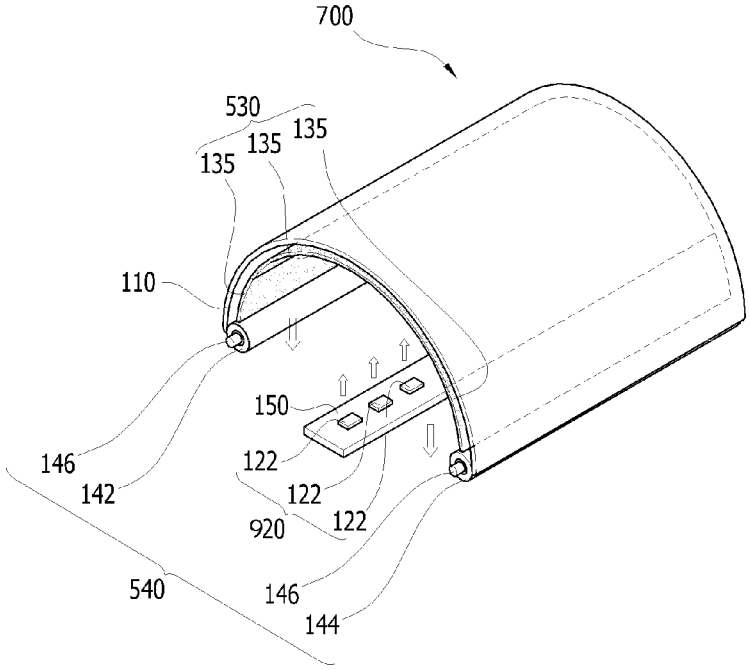
FIG. 9 is a perspective view illustrating the constructed lighting apparatus in FIG. 8.

FIG. 8 is an exploded perspective view illustrating a lighting apparatus according to still another exemplary embodiment of the present invention, and FIG. 9 is a perspective view illustrating the constructed lighting apparatus in FIG. 8.

Referring to FIGS. 8 and 9, a lighting apparatus 700 according to the present embodiment includes a light reflector 110, an LED part 920, a fluorescent film 530 and a driving part 540.

The light reflector 110 has an arch-shaped cross-section and is extended along longitudinal direction thereof.

The LED part 920 is disposed under the light reflector 110, and has at least one LED 122. The at least one LED 122 may be arranged in a line along a first direction on a PCB 150. Alternatively, the LEDs 122 may be arranged in two lines along the first direction on the PCB 150.

A blue LED or an UV LED may be employed as the LED 122.

The fluorescent film 530 has first to n-th fluorescent substance parts 135, each of which converts light generated by the LED into different colored light. The fluorescent film 530 may include, for example, poly ethylene terephtalate (PET) or polycarbonate (PC). The fluorescent film 530 may be disposed such that the fluorescent film 530 wraps the LEDs 122 disposed under the light reflector 110. The fluorescent film 530 and the LED part 920 are spaced apart from each other to prevent the fluorescent film 530 from being discolored by heat generated by the LED part 920.

Each of the first to n-th fluorescent substance parts 135 may include at least one of a red fluorescent substance and a green fluorescent substance, to generate red light, green light or white light. The red fluorescent substance may include barium-silicate based material, and the green fluorescent substance may include strontium sulfide based material.

The driving part 540 includes a selection part 146 for winding up the fluorescent film 530, and one of the first to n-th fluorescent substance parts 135 may be selected through the driving part 540. The driving part 540 may further include a first supporting part 142 and a second supporting part 144 formed at an end portion of the light reflector 110 to fix the light reflector 110. The first supporting part 142 and the second supporting part 144 of the driving part 540 may be formed at first and second end portions of the light reflector 110, respectively.

The lighting apparatus 700 described above uses the LED part 920 as a light source. A first light generated by the LED part 920 is converted into a second light through the fluorescent film 530. Each of the fluorescent substance parts 135 of the fluorescent film 530 has different kind of or different amount of fluorescent substance, so that the second light may have various characteristics.

For example, when white light is required, a blue LED and red and green fluorescent substance may be used. In the present exemplary embodiment, the lighting apparatus 700 employs, for example, a blue LED as a light source. The first light generated by the blue LED is converted into white light by the fluorescent film 530. The fluorescent film 530 may have the first to n-th fluorescent substance parts 135, each of which has different ratio of red fluorescent substance to green fluorescent substance.

For example, the first fluorescent substance part 135 has 5% of red fluorescent substance and 95% of green fluorescent substance, the second fluorescent substance part 135 has 10% of red fluorescent substance and 90% of green fluorescent substance, . . . , and the n-th fluorescent substance part 135 has A % of red fluorescent substance and (100-A) % of green fluorescent substance.

When the ratio of red fluorescent substance to green fluorescent substance varies between the adjacent fluorescent substance parts 135, a gradual color change may be obtained and various colored light such as cool white and warm white may be obtained.

When the selection part 146 is rotated along a first direction or a second direction, one of the first to n-th fluorescent substance parts 135 is selected.

Additionally, the fluorescent film 530 may further include an (n+1)-th fluorescent substance part 135 having no fluorescent substance. Therefore, when the (n+1)-th fluorescent substance part 135 is selected, blue light or UV light generated by the LED part 920 may be directly illuminated.

Figure 10:
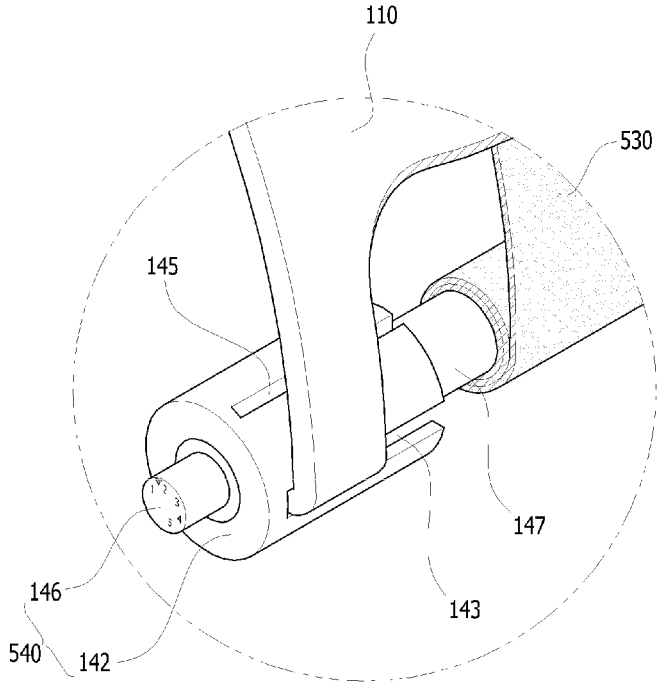
FIG. 10 is a partially cut-out perspective view illustrating a driving part in FIG. 8.

FIG. 10 is a partially cut-out perspective view illustrating a driving part in FIG. 8. In FIG. 10, the light reflector 110 and the second supporting part are illustrated in a state partially cut-out.

Referring to FIG. 10, the driving part 540 may further include a first supporting part 142 and a second supporting part 144 connected to the light reflector 110. The first supporting part 142 and the second supporting part 144 are disposed at first and second end portions of the light reflector 110, respectively. The first supporting part 142 and the second supporting part 144 may have, for example, a cylindrical shape.

The first supporting part 142 and the second supporting part 144 have a first hole 143 formed on a surface thereof. The first hole 143 is extended along longitudinal direction of the first supporting part 142 and the second supporting part 144. An end portion of the light reflector 110 is inserted into the first hole 143, so that the first supporting part 142 and the second supporting part 144 are combined with the light reflector 110. A rotation shaft 147 may be connected with the selection part 146, and inserted into the first supporting part 142 and the second supporting part 144.

The first supporting part 142 and the second supporting part 144 may further include a second hole 145 formed on a surface thereof. The second hole 145 may be parallel with the first hole 143. The fluorescent film 530 penetrates the second hole 145 to be wound up by the rotation shaft 147. Therefore, when the selection part 146 is rotated, the rotation shaft 147 is also rotated to wind up the fluorescent film 530.

Even when the selection part 146 is rotated, the first supporting part 142 and the second supporting part 144 are stationary to fix the light reflector 110.

When the first supporting part 142 and the second supporting part 144 are not extended along a longitudinal direction of the light reflector 110 as illustrated in FIG. 10, the first supporting part 142 and the second supporting part 144 do not require the second hole 145.

Figure 11:
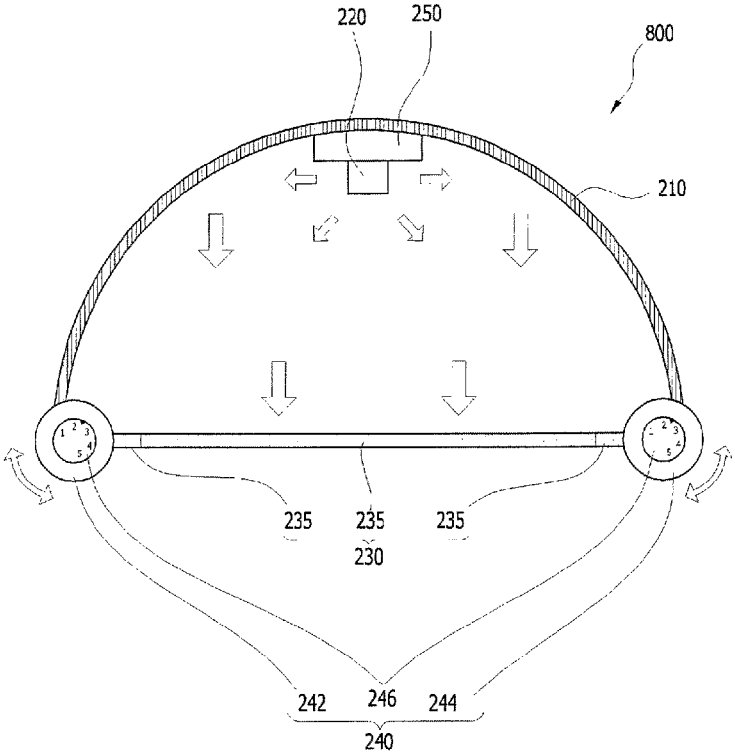
FIG. 11 is a cross-sectional view illustrating a lighting apparatus according to still another exemplary embodiment of the present invention.

FIG. 11 is a cross-sectional view illustrating a lighting apparatus according to still another exemplary embodiment of the present invention. The lighting apparatus 800 in FIG. 11 is substantially the same as the lighting apparatus 700 in FIG. 8 and FIG. 9, except for the position of the LED part 220, a PCB 250 and a fluorescent film 230. Thus, same reference numbers will be used for the same elements and any further explanation will be omitted.

Referring to FIG. 11, the lighting apparatus 800 according to the present exemplary embodiment includes a light reflector 210, an LED part 220, a fluorescent film 230 and a driving part 240. The LED part 220 of the lighting apparatus 800 may be disposed such that the second surface of the LED part 220, which is opposite to the first surface emitting light, is adjacent to a concave surface of the light reflector 210.

The light reflector 210 has an arch-shaped cross-section, and is extended along a first direction.

The LED part 220 is disposed under the light reflector 210, and includes at least one LED. The LEDs may be mounted on the PCB 250 along the first direction. Alternatively, the LEDs may be arranged in two lines along the first direction on the PCB 250.

A blue or UV LED may be employed as the LED of the LED part 220.

The fluorescent film 230 includes first to n-th fluorescent substance parts 235 to generate different colored light by using blue or UV light generated by the LED part 220. The fluorescent film 230 facing the first surface of the LED part 220 defines a chord between the first supporting part 242 and the second supporting part 244, the chord corresponding to an arc defined by the light reflector 210.

The driving part 240 includes a selection part 246 for winding up the fluorescent film 230, and one of the first to n-th fluorescent substance parts 235 may be selected through the driving part 240. The driving part 240 may further include the first supporting part and the second supporting part 244 formed at an end portion of the light reflector 210 to fix the light reflector 210. The first supporting part 242 and the second supporting part 244 of the driving part 240 may be formed at first and second end portions of the light reflector 210, respectively.

The first light generated by the LED part 220 is converted into the second light by the fluorescent film 230. According to the lighting apparatus 800, a user may select a color by rotating the selection part 246 for winding up the fluorescent film 230 as described in the previous embodiment in FIG. 8 and FIG. 9. However, according to the present embodiment, the fluorescent film 230 is flat, whereas the fluorescent film 530 in FIG. 8 and FIG. 9 is curved, so that an operation time required for winding up may be reduced.

Figure 12:
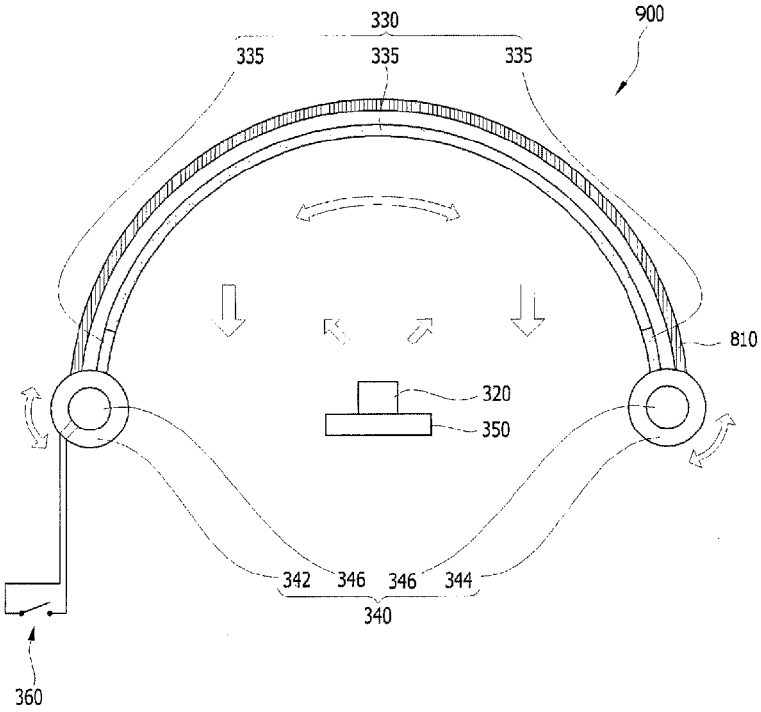
FIG. 12 is a cross-sectional view illustrating a lighting apparatus according to still another exemplary embodiment of the present invention.

FIG. 12 is a cross-sectional view illustrating a lighting apparatus according to still another exemplary embodiment of the present invention. The lighting apparatus 900 in FIG. 12 is substantially the same as the lighting apparatus 700 in FIG. 8 and FIG. 9, except for an electrical rotating part 360. Thus, same reference numbers will be used for the same elements and any further explanation will be omitted.

Referring to FIG. 12, the lighting apparatus 900 according to the present exemplary embodiment includes a light reflector 810, an LED part 320, a fluorescent film 330 and a driving part 340. The lighting apparatus 900 may further include an electrical rotating part 360 electrically connected to the selection part 346 to rotate a rotation shaft for winding up the fluorescent film 330.

The light reflector 810 has an arch-shaped cross-section and is extended along longitudinal direction thereof.

The LED part 320 is disposed under the light reflector 810, and has at least one LED. The at least one LED may be arranged in a line along a first direction on a PCB 350. Alternatively, the LEDs may be arranged in two lines along the first direction on the PCB 350.

A blue LED or an UV LED may be employed as the LED.

The fluorescent film 330 has first to n-th fluorescent substance parts 335, each of which converts light generated by the LED of the LED part 320 into different colored lights. The fluorescent film 330 may be disposed such that the fluorescent film 330 wraps the LEDs disposed under the light reflector 810. The fluorescent film 330 and the LED part 320 are spaced apart from each other to prevent the fluorescent film 330 from being discolored by heat generated by the LED part 320.

The driving part 340 includes a selection part 346 for winding up the fluorescent film 330, and one of the first to n-th fluorescent substance parts 335 may be selected through the driving part 340. The driving part 340 may further include a first supporting part 342 and a second supporting part 344 formed at an end portion of the light reflector 810 to fix the light reflector 810. The first supporting part 342 and the second supporting part 344 of the driving part 340 may be formed at first and second end portions of the light reflector 810, respectively.

The electrical rotating part 360 may include, for example, a toggle switch, or push switch. For example, when the electrical rotating part 360 is in a first state, the selection part 346 rotates along a clock-wise direction, or when the electrical rotating part 360 is in a second state, the selection part 346 rotates along a counter clock-wise direction to wind up the fluorescent film 330. The electrical rotating part 360 may include, for example, two motors connected to a first rotation shaft (not shown) of the first supporting part 342 and a second rotation shaft (not shown) of the second supporting part 344, respectively. When at least one of two motors operates, one of the first to n-th fluorescent substance parts 335 in the fluorescent film 330 may be selected.

According to the present embodiment, the electrical rotating part 360 may be easily operated to select one of the first to n-th fluorescent substance parts 335 of the fluorescent film 330. Furthermore, the lighting apparatus 900 may be equipped at a position higher than a user's reach.

For example, the lighting apparatus 900 may be equipped at the ceiling of the room, and the electrical rotating part 360 may be equipped at a wall within a user's reach, so that color of the lighting apparatus 900 may be controlled easily.

Figure 13:
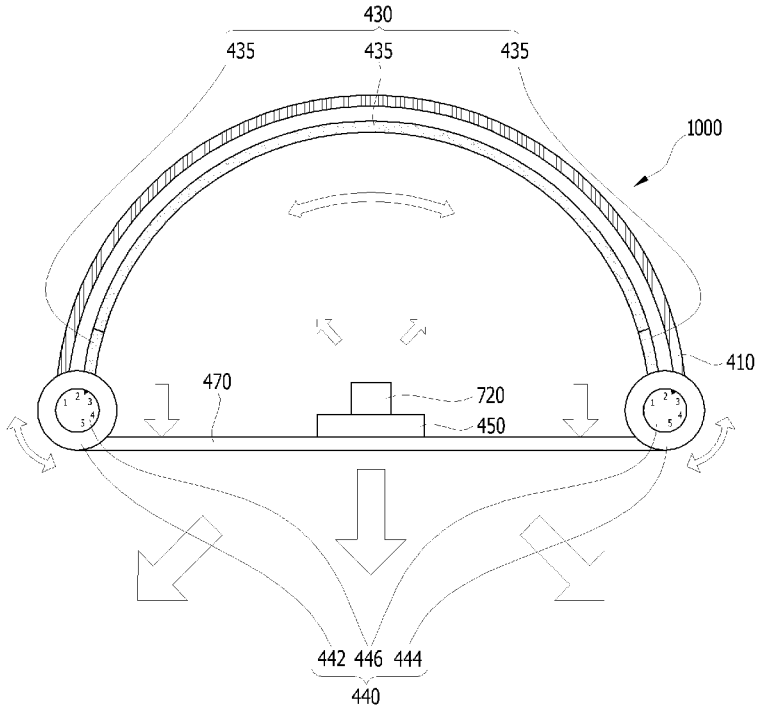
FIG. 13 is a cross-sectional view illustrating a lighting apparatus according to still another exemplary embodiment of the present invention.

FIG. 13 is a cross-sectional view illustrating a lighting apparatus according to still another exemplary embodiment of the present invention. The lighting apparatus 1000 in FIG. 13 is substantially the same as the lighting apparatus 700 in FIG. 8 and FIG. 9, except for a light-diffusing plate 470. Thus, same reference numbers will be used for the same elements and any further explanation will be omitted.

Referring to FIG. 13, a lighting apparatus 1000 includes a light reflector 410, an LED part 720, a fluorescent film 430 and a driving part 440. The lighting apparatus 1000 may further include a light-diffusing plate 470 disposed adjacent to a second surface of the LED part 720, wherein the second surface of the LED part 720 faces an opposite direction of the fluorescent film 430 and a first surface of the LED part 720 is opposite to the second surface of the LED part 720. The light-diffusing plate 470 diffuses light generated by the LED part 720 to improve brightness uniformity.

The light reflector 410 has an arch-shaped cross-section and extends along a longitudinal direction thereof.

The LED part 720 is disposed under the light reflector 410, and has at least one LED. The at least one LED may be arranged in a line along a first direction on a PCB 450. Alternatively, the LEDs may be arranged in two lines along the first direction on the PCB 450.

A blue LED or an UV LED may be employed as the LED.

The fluorescent film 430 has first to n-th fluorescent substance parts 435, each of which converts light generated by the LED into different colored lights. The fluorescent film 430 may be disposed such that the fluorescent film 430 wraps the LEDs disposed under the light reflector 410. The fluorescent film 430 and the LED part 720 are spaced apart from each other to prevent the fluorescent film 430 from being discolored by heat generated by the LED part 720.

The driving part 440 includes a selection part 446 for winding up the fluorescent film 430, and one of the first to n-th fluorescent substance parts 435 may be selected through the driving part 440. The driving part 440 may further include a first supporting part 442 and a second supporting part 444 formed at an end portion of the light reflector 410 to fix the light reflector 410. The first supporting part 442 and the second supporting part 444 of the driving part 440 may be formed at first and second end portions of the light reflector 410, respectively.

According to some exemplary embodiments of the present invention, a color of light illuminated by the lighting apparatus may be adjusted by using the fluorescent film having the first to n-th fluorescent substance parts, in detail, by rotating the selection part for selecting one of the first to n-th fluorescent substance parts of the fluorescent film.

Furthermore, the lighting apparatus having electrical rotating part connected to the selection part may be equipped at a position beyond a user's reach.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A lighting apparatus, comprising:

a light emitting diode (LED);

a light reflector having a convex outer surface, and a concave inner surface that is configured to reflect light emitted from the LED;

an illumination width adjusting part to adjust the distance between first and second edges of the light reflector by compressing opposing side portions of the light reflector; and a light-changing film disposed directly on the inner surface of the light reflector and configured change the wavelength of the light emitted from the LED, wherein the light changing film is disposed between the inner surface of the light reflector and the LED, such that substantially all of the reflected light passes through the light changing film before being reflected, and wherein ends of the light changing film are spaced apart from the light reflector by an air gap, when the light reflector is not compressed by the illumination width adjusting part.

2. The lighting apparatus of claim 1, wherein the light-changing film is a fluorescent film to increase the wavelength of the light.

3. The lighting apparatus of claim 2, wherein the fluorescent film is spaced apart from the LED.

4. The lighting apparatus of claim 3, wherein:

the LED has an emitting surface to emit the light and an opposing non-emitting surface; and the LED is disposed such that the emitting surface faces the fluorescent film.

5. The lighting apparatus of claim 3, wherein the lighting apparatus further comprises a plurality of the LEDs arranged in a row that extends parallel to the first and second edges of the light reflector.

6. The lighting apparatus of claim 5, wherein the LEDs comprise at least two of a blue LED, a green LED, and a red LED, which are alternately disposed in the row.

7. The lighting apparatus of claim 5, wherein the emitting surface of each LED faces the inner surface of the light reflector.

8. The lighting apparatus of claim 7, wherein the fluorescent film is disposed between the light reflector and the LEDs.

9. The lighting apparatus of claim 8, further comprising a light-diffusing plate to diffuse light reflected by the light reflector.

10. The lighting apparatus of claim 1, wherein the illumination width adjusting part comprises:

a supporting part disposed adjacent to the side portions of the light reflector; and a screw penetrating the supporting part and contacting one of the side portions of the light reflector, the screw configured to move forward or backward to adjust the distance between the first and second edges of the light reflector.

11. The lighting apparatus of claim 10, wherein the illumination width adjusting part further comprises:

a motor to rotate the screw; and a control part to control the motor.

12. The lighting apparatus of claim 1, wherein:

the light reflector has substantially linear opposing first and second edges; and the inner and outer surfaces extend from the first edge to the second edge.

13. A lighting apparatus, comprising:

a light emitting diode (LED) part;

a light reflector disposed over the LED part and having an inner surface configured to reflect light emitted from the LED part;

a fluorescent film disposed to receive the light emitted from the LED part, portions of the fluorescent film comprising fluorescent substances, such that the portions each emit different colors of light; and a driving part to adjust the fluorescent film, such that different ones of the portions of the fluorescent film cover the inner surface of the light reflector and receive the light emitted by the LED part, wherein each portion is large enough to cover substantially all of the inner surface of the light reflector, and wherein the fluorescent film comprises a continuous film.

14. The lighting apparatus of claim 13, wherein each of the portions of the fluorescent film comprises a red fluorescent substance, a green fluorescent substance, or a combination thereof.

15. The lighting apparatus of claim 14, wherein portions of the fluorescent film that comprises both the red fluorescent substance and the green fluorescent substance each comprise different amounts of the red fluorescent substance and the green fluorescent substance.

16. The lighting apparatus of claim 13, wherein:

the LED part comprises a blue LED or an ultraviolet LED; and a portion of the fluorescent film is transparent to light emitted by at least the blue LED or the ultraviolet LED.

17. The lighting apparatus of claim 13, wherein the driving part comprises:

a supporting part to fix the light reflector;

a rotation shaft connected to the fluorescent film; and a selection part configured to select each portion of the fluorescent film by rotating the rotation shaft, such that the fluorescent film is wound onto and unwound from the rotation shaft, according to corresponding rotation directions of the rotation shaft.

18. The lighting apparatus of claim 17, wherein the driving part further comprises an electrical motor to rotate the rotation shaft.

19. The lighting apparatus of claim 13, wherein the fluorescent film and the LED part are spaced apart from each other.

20. The lighting apparatus of claim 19, wherein the LED part has an emitting surface from which the light is emitted and an opposing non-emitting surface, the emitting surface facing the inner surface of the light reflector.

21. The lighting apparatus of claim 19, wherein the LED part has an emitting surface from which the light is emitted and an opposing non-emitting surface, the non-emitting surface facing the inner surface of the light reflector.

22. The lighting apparatus of claim 13, wherein the driving part comprises:

a supporting part to fix the light reflector;

first and second rotation shafts respectively connected to opposing ends of the fluorescent film; and a selection part configured to select each portion of fluorescent film by rotating the rotation shafts, such that the fluorescent film is wound around one of the first and second rotation shafts and unwound from the other of the first and second rotation shafts.

23. The lighting apparatus of claim 12, wherein the fluorescent film is spaced apart from the inner surface of the light reflector.

* * * * *